US005114213A

United States Patent [19]

Kornecki et al.

[11] Patent Number: 5,114,213

[45] Date of Patent: May 19, 1992

[54] HIGH PRESSURE WATER ASSISTED MINING AND TUNNELLING MACHINE

[75] Inventors: Julian Kornecki, Secunda, South Africa, by Mark Yammin; Charles J. Armstrong, deceased, late of Johannesburg, South Africa, by Mark Yammin, legal representative

[73] Assignee: Sasol Mining (Proprietary) Limited, Johannesburg, South Africa

[21] Appl. No.: 660,338

[22] Filed: Feb. 22, 1991

Related U.S. Application Data

[63] Continuation of Ser. No. 314,719, Feb. 23, 1989, abandoned.

[30] Foreign Application Priority Data

Feb. 26, 1988 [ZA] South Africa ..... 88/1364

[51] Int. Cl.[5] ..... E21C 35/22

[52] U.S. Cl. ..... 299/81; 299/53

[58] Field of Search ..... 299/12, 17, 42, 53, 299/81; 239/101

[56] References Cited

U.S. PATENT DOCUMENTS 4,049,318 9/1977 Fruin ..... 299/81

FOREIGN PATENT DOCUMENTS 0225079 6/1987 European Pat. Off. .
0235319 9/1987 European Pat. Off. ..... 299/81
3216936 11/1983 Fed. Rep. of Germany ..... 299/81
3527779 2/1987 Fed. Rep. of Germany ..... 299/81
3618779 12/1987 Fed. Rep. of Germany ..... 299/81
1384295 2/1975 United Kingdom .
1481198 7/1977 United Kingdom .
2161186 1/1986 United Kingdom .

*Primary Examiner*—David J. Bagnell
*Attorney, Agent, or Firm*—Michael, Best & Friedrich

[57] ABSTRACT

An accessory for a mining or tunnelling machine comprising a cutting drum is disclosed. The accessory comprises a radial piston pump mountable in the cutting drum, the pump comprising a plurality of piston and cylinder assemblies adapted to supply water under pressure to a nozzle or nozzles mounted in the periphery of the drum.

12 Claims, 6 Drawing Sheets

HIGH PRESSURE WATER ASSISTED MINING AND TUNNELLING MACHINE

The present application is a continuation of U.S. application Ser. No. 07/314,719 of Feb. 23, 1989, now abandoned.

FIELD OF THE INVENTION

This invention relates to mining and tunnelling machines. More particularly, the invention relates to machines adapted for cutting rock, coal, ore and the like, utilising rotating cutting means such as drums armed with picks, such as longwall shearers, continuous miners, roadheaders and the like, and to a method of cutting rock, coal, ore and the like, utilising such rotating drums.

BACKGROUND OF THE INVENTION

It has been found by others that the operation of the machines referred to in the opening paragraph can be significantly improved with the aid of high pressure water sprayed on to the material to be cut. Not only does the high pressure water enhance the cutting action of the picks, but it also serves to improve the environment by reducing the amount of dust that is liberated into the atmosphere during cutting. Water pressures of up to 60 bars have been found by others to yield good results. However, recent developments in the art indicate that pressures of between 200 and 2000 bars produce even better results. At pressures of around 1500 bars it has been found that pick life can be increased by a factor of about 10 to 20.

To provide water to the rotating drums of such machines at an intermediate pressure of 10 to 60 bars does not create serious technical problems. Systems are in operation in which water at such intermediate pressures is supplied to the rotating drum by means of booster pumps either mounted on board the cutting machine or at some distance away therefrom. In the context of conventional mining machines using high pressure water, on board booster pumps are either located on the chassis of the machines or are built into ranging arms adapted to raise and lower the cutting drum. However, to supply water to the cutting drum at high pressures, for instance pressures of more than 200 bars, creates a serious technical problem. The further the pump is located away from the cutting drum, the longer the length of hoses or pipes that have to be provided to convey the water to the cutting drum and therefore the more vulnerable the hoses become to damage from the environment, such as falling rocks and the like. It will also be appreciated that the higher the pressure of the water, the more damage could be done to both operating personnel and equipment, by water escaping from burst or leaking hoses. Furthermore, since the cutting drum rotates during use, and the nozzles thereon require a high pressure only during a part of each revolution of the drum, expensive water swivels and sequence valves are required for such systems.

Booster pumps located in the ranging arms of such machines offer the advantage that they are protected from falling rocks and the like and are concealed from operating staff, but they are mechanically complicated and suffer from the disadvantage that any water leakage could contaminate lubrication oil usually present in such ranging arms as such arms usually also house a gearbox or other drive means for driving the cutting drum. Furthermore, the maintenance of such pumps is complicated because of their location in the ranging arm and the need for expensive water swivels and sequence valves still exists.

OBJECTS AND SUMMARY OF THE INVENTION

It is an object of the present invention to provide an accessory for a mining machine which is adapted to supply high pressure water to nozzles located on the cutting means, e.g. drum, and is less expensive to manufacture and operate than conventional high pressure water assisted cutting systems.

According to one aspect of the present invention, there is provided an accessory for a mining or tunnelling machine comprising a rotary cutting means, drum, or the like cutting tool, the accessory including a radial piston pump comprising a plurality of piston and cylinder assemblies, each piston and cylinder assembly being adapted to supply water under pressure to a nozzle adapted to direct the water onto material to be cut by the machine, the radial piston pump being mountable in the rotary cutting means, more particularly coaxially therein.

The accessory may comprise more than one pump, and where it comprises more than one pump, the pumps may be arranged so that one pump is axially spaced from the other. Alternatively or additionally, the or each pump may comprise two or more banks of piston and cylinder assemblies.

The number of piston and cylinder assemblies of the or each pump could vary depending for instance on the number of nozzles that have to be supplied with high pressure water, the dimensions of the drum or the like, and the dimensions of each piston and cylinder assembly.

As will be appreciated, the smaller the number of piston and cylinder assemblies, the more uneven the pressure will be that is supplied to the nozzles located in the operating area of the rotary means, e.g. periphery of the drum. Conversely, the larger the number of pistons, the more constant the pressure would become, but at the same time, the more prone the accessory would become to mechanical problems. So as to alleviate this problem, the water may be supplied via a manifold to each or at least some of the nozzles.

The required cutting speed of the drum, and hence, the speed at which the or each pump will rotate, depends upon the type of coal or other material that is to be cut by the machine. It has been found by the applicant, however, that for coal using a drum of 1.8 m diameter, a speed of from 30 to 50 rpm is suitable, preferably from about 33 rpm to about 48 rpm. For other applications, different drum diameters and rotational speeds may be utilised.

It will be appreciated that, by increasing the speed of the cutting drum during use thereof, higher water pressures and flow rates could be obtained.

Low pressure water may be supplied to the pump via a low pressure swivel which may be mounted on the goaf side of the drum shaft and connected to a supply of low pressure water. The low pressure swivel may be connected to each cylinder via passage means coaxial with the drum shaft, e.g. a hollow rod extending through a bore of the shaft which is hollow as well. One end of the rod may be connected to the low pressure water swivel and the other end may have one or more passages, the or each passage interconnecting a cylinder of the pump with the hollow rod.

One end of the rod may be adapted to be held in any one of a plurality of substantially fixed positions. The other end of the rod may comprise a cam adapted to cause the pistons of the pumps to reciprocate when the pump is rotated.

The cam may be in the form of a cylindrical formation eccentrically mounted on the rod.

Water flow rates of from 10 to 80, preferably about 40 liters per drum per minute have been found to yield satisfactory results when the accessory is used with presently available longwall shearers. It will be appreciated that the gross flow rate per drum has to be divided by the number of piston and cylinder assemblies in order to obtain a desired flow rate per piston and cylinder assembly. It will also be appreciated that the higher the flow rate of water, the less dust will be liberated during cutting, but then the more water would have to be disposed of at the face and this may present problems in underground collieries.

The preferred accessory according to the invention is adapted for easy retrofitting to existing mining and tunneling machines.

The invention also extends to a method of mining or tunnelling, including the step of providing water at high pressure to a nozzle or nozzles directed at rock material being excavated by a rotary cutting means, such as a cutting drum forming part of a mining machine, the high pressure water being provided by means of a radial piston pump mounted in the rotary cutting means of the said machine.

The invention also extends to mining and tunnelling machines equipped with the accessory according to the invention.

BRIEF DESCRIPTION OF THE DRAWINGS

The invention will now be described, by way of example, with reference to the accompanying drawings, in which.

DETAILED DESCRIPTION OF THE DRAWINGS

Figure 1:
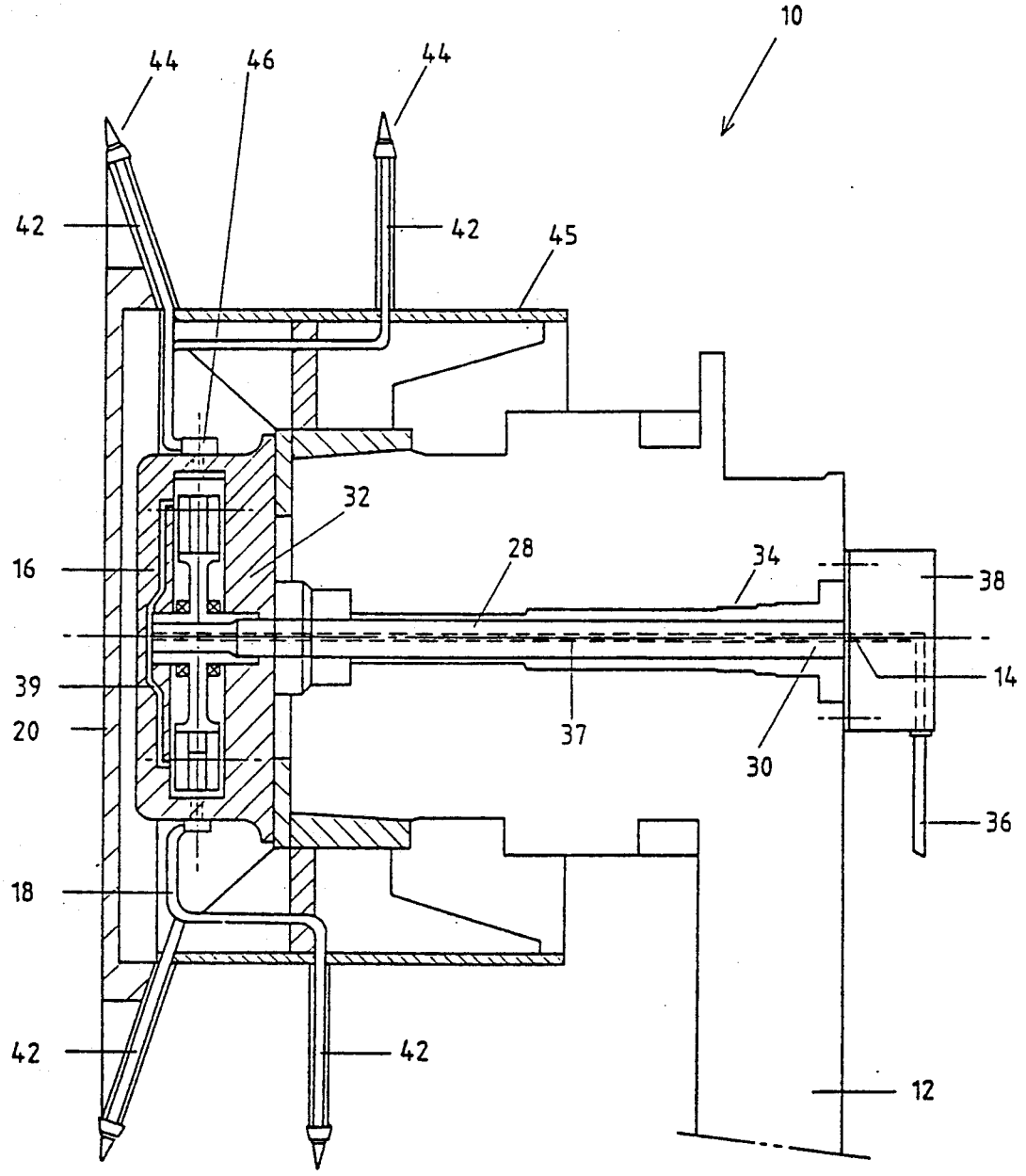
FIG. 1 shows a partly sectionalized side elevation of an accessory in accordance with the invention, the accessory being mounted in the cutting drum of a longwall shearer.
Figure 5:
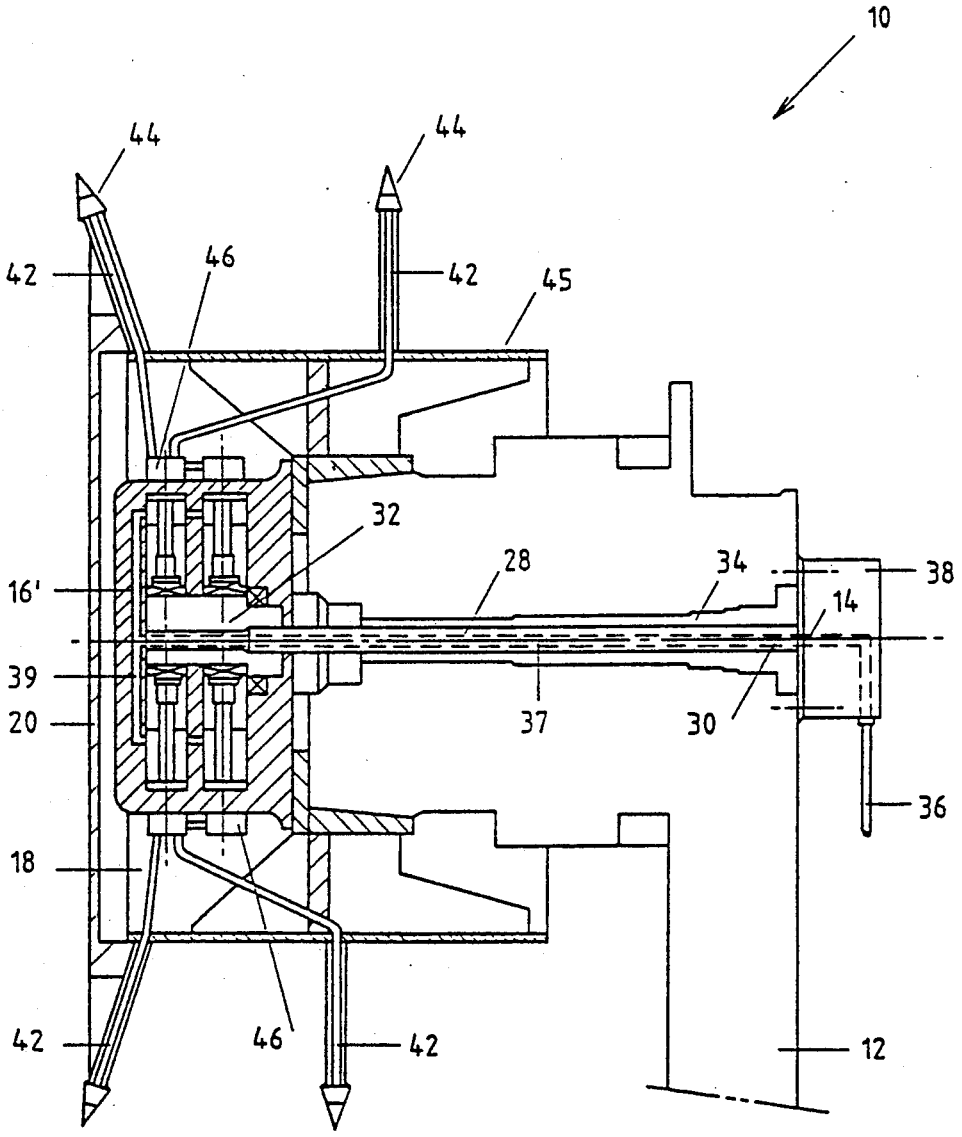
FIG. 5 shows a partly sectionalized side elevation of an accessory comprising a rotary piston pump having two banks of piston and cylinder assemblies.

Referring to FIG. 1, reference numeral 10 generally indicates a cutting drum of a longwall shearer (shown in FIG. 5). The cutting drum 10 is mounted on the end of a ranging arm 12 of the longwall shearer and drive means (not shown) is provided in the ranging arm 12 for driving the cutting drum 10. The cutting drum 10 is mounted such that it can rotate about the axis 14. A radial piston pump 16 is mounted coaxially in an outwardly facing cavity 18 of the cutting drum 10 and is protected from the exterior by means of a lid 20. Lugs 22 (see FIG. 2) are provided on the shell 24 of the pump 16 for facilitating the mounting thereof in the cavity 18. Although lugs 22 are used in the embodiments shown in the drawings, for mounting the pump 16, it will be appreciated by those skilled in the art that alternative means of mounting may be employed depending upon the geometry of the cutting drum of a particular longwall shearer.

Figure 2:
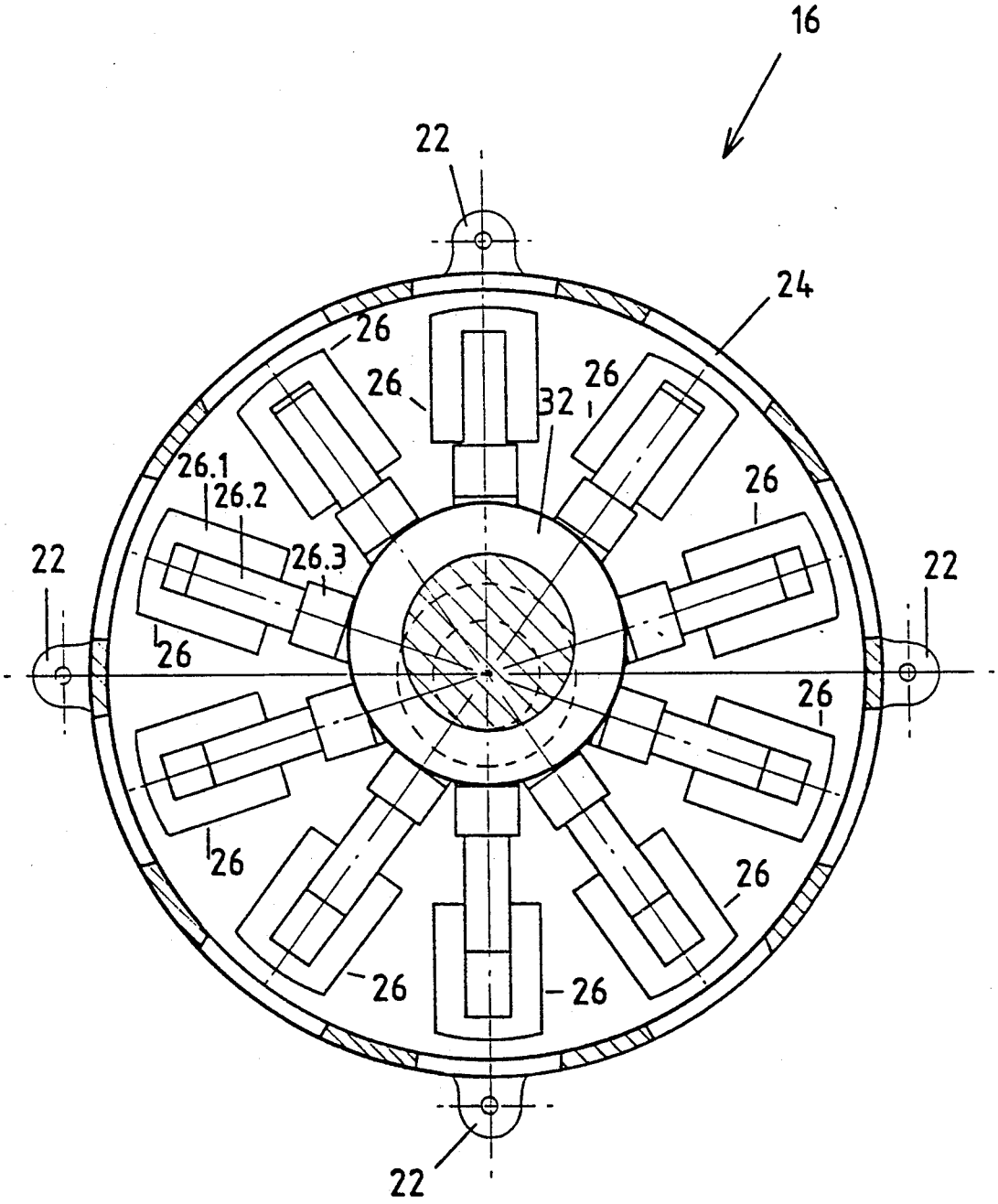
FIG. 2 shows a partly sectionalized front elevation of a rotary piston pump forming part of an accessory in accordance with the invention.
Figure 3:
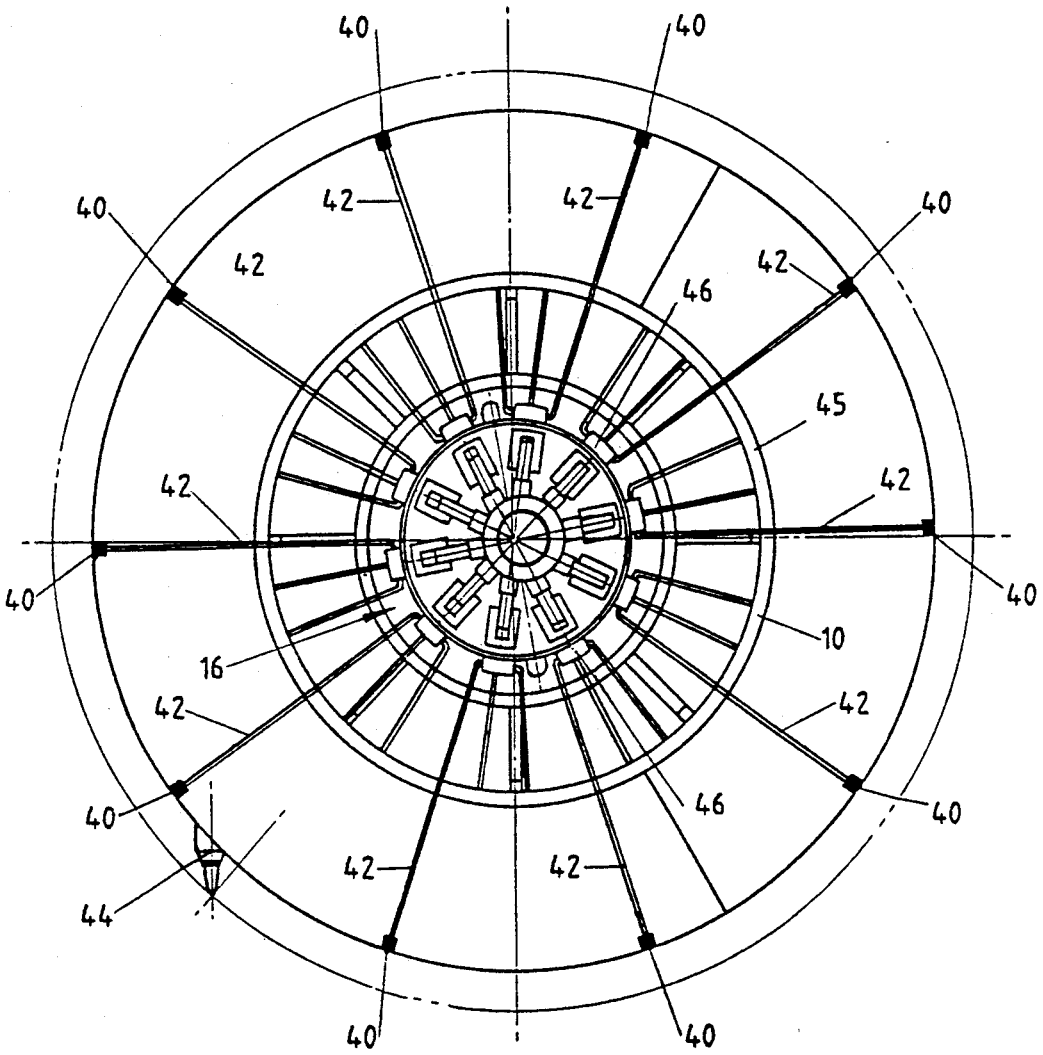
FIG. 3 shows a partly sectionalized front elevation of the cutting drum and the accessory of FIG. 1.
Figure 6:
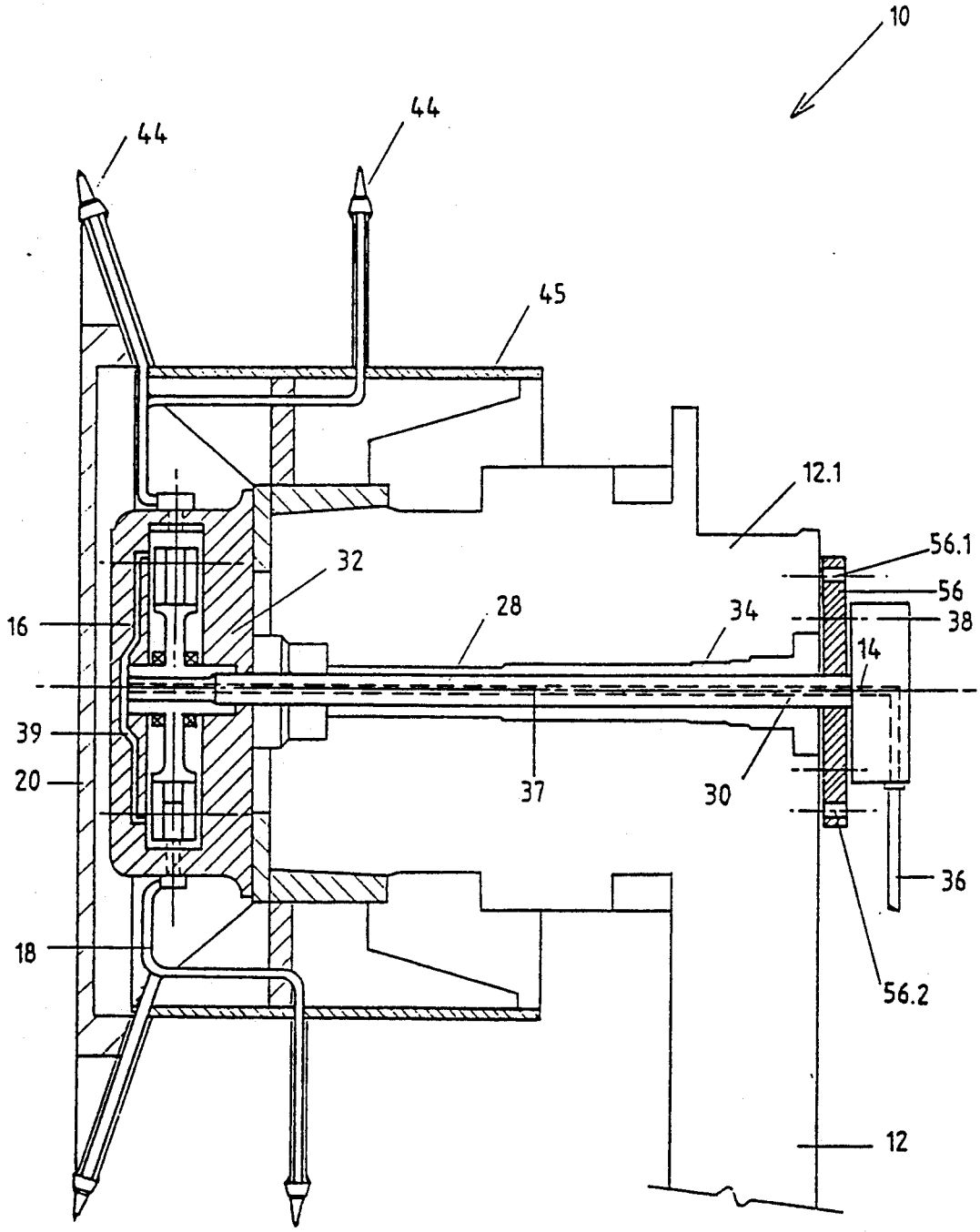
FIG. 6 shows a partly sectionalized side elevation of an accessory as shown in FIG. 1, comprising a rod adapted to be held in any one of a plurality of fixed position.

As can be seen in FIGS. 2 and 3, the pump 16 comprises ten radially orientated piston and cylinder assemblies 26. A hollow rod 28 which extends axially through the drum 10, is provided, one end 30 thereof being adapted to be held in one of two positions 180° apart from each other (details of which are shown in FIG. 6). A cam 32 is provided on the other end of the rod 28, the cam 32 being of cylindrical or spherical shape and being mounted eccentrically with regard to the axis of the rod 28.

The rod 28 extends through a hollow shaft 34 interconnecting the drive means in the ranging arm 12 with the cutting drum 10. An annular space (not shown) is provided between the interior surface of the shaft 34 and the rod 28. Low pressure water is fed to the pump 16 through a hose 36 coupled to a low pressure swivel 38 which in turn communicates with the cylinders of the pump 16 through the bore 37 of the rod 28 and passages 39 in the housing of the pump 16 communicating with the bore of the rod 28. High pressure water discharged from the cylinders is fed to nozzles 40 (see FIG. 3), by means of tubes 42 which may be made of stainless steel, the nozzles 40 being provided in the vicinity of picks 44 projecting from the shell 45 of the cutting drum 10. A circumferentially extending annular manifold 46, which may be segmented, is provided to be in communication with the discharge of each piston and cylinder assembly through a combined inlet/outlet valve (not shown).

Each piston and cylinder assembly 26 comprises a cylinder 26.1 and a piston 26.2 provided with a formation 26.3 adapted to engage with the cam 32.

Figure 4:
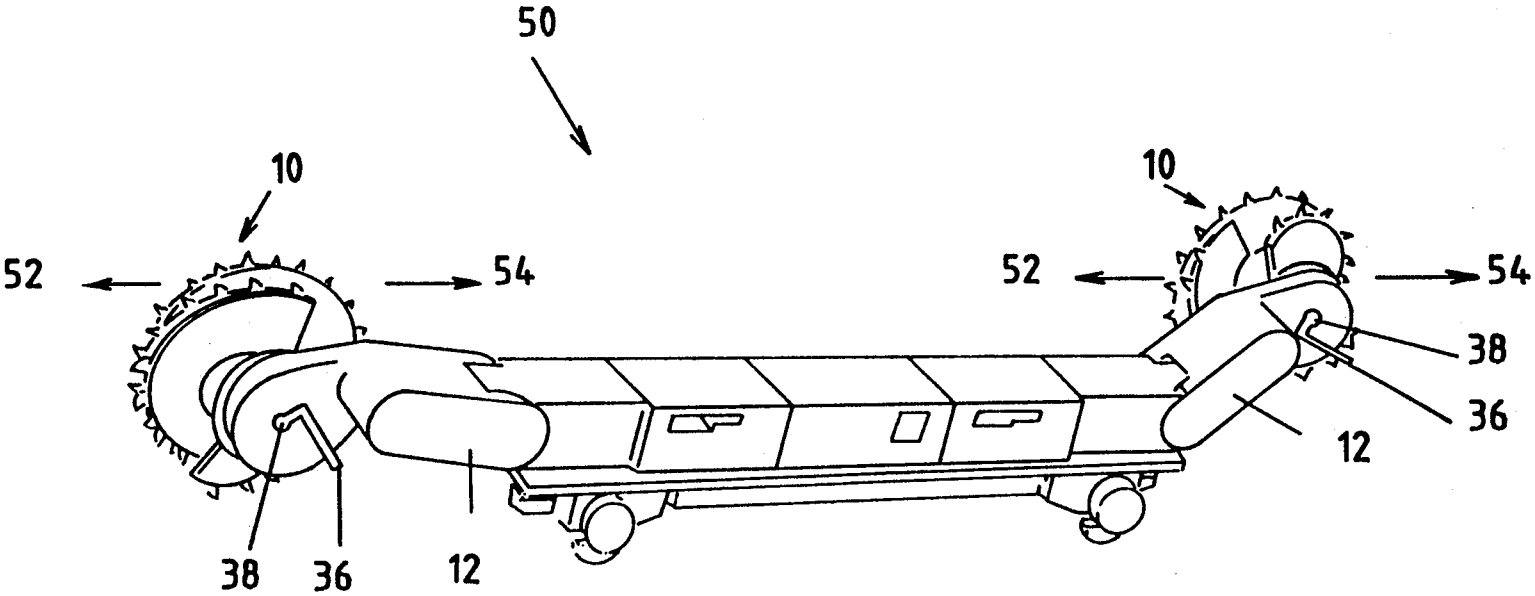
FIG. 4 shows a conventional long wall shearer employing the accessory of FIGS. 1 to 3.

FIG. 4 shows a conventional long wall shearer 50 fitted with an accessory in accordance with the invention. The shearer 50 comprises two cutting drums 10 and two ranging arms 12. The shearer 50 is capable of cutting either in the direction as indicated by the arrows 52 or in the direction as indicated by the arrows 54.

In FIG. 5 is shown a partly sectionalized side elevation of an accessory comprising a rotary piston pump 16' having two banks of piston and cylinder assemblies 26. This embodiment of the invention provides a solution where it is desirable for each nozzle to be connected to a piston and cylinder assembly and the number of piston and cylinder assemblies thus required exceeds the number which could be accommodated in the diameter of the cavity 18.

FIG. 6 shows a circular plate 56 rigidly connected to the rod 28. The plate 56 is provided with holes 56.1, 56.2 through which it is removably connectable by means of bolts (not shown) to the end 12.1 of the ranging arm 12.

In use, the cutting drum 10 of a longwall shearer 50 is positioned so that the picks 44 engage with the material to be cut. The drum 10 is then driven through the drive means located in the ranging arm 12. The pump 16 rotates with the cutting drum 10, whilst the rod 28 is held stationary by means of the plate 56 in either of the two aforementioned positions. Rotation of the pump 16 about the cam 32 which is held stationary by the rod 28, causes the pistons 26.2 to reciprocate in the cylinders 26.1, with the result that low pressure water supplied to the cylinders through the hose 36, swivel 38 and bore of the rod 28, is pressurized and discharged to the nozzles 40 via the combined inlet/outlet valves, the manifold 46 and the tubes 42. The water discharged by the nozzles 40 is directed onto the material being cut by the picks 44, thereby assisting the cutting action of the picks 44 and suppressing dust caused by the cutting action.

It will be appreciated that each piston and cylinder assembly 26 supplies high pressure water only during one half of a drum revolution, whilst for the balance of each revolution low pressure water flows to such piston and cylinder assembly 26. The position of the rod 28 is selected such as to ensure that water is discharged from the nozzles 40 located in the vicinity of picks 44 being in contact with the material to be cut. Under circumstances where the shearer 50 is used to cut in the direction 52, the rod 28 will be in one position and when the shearer 50 is used to cut in the opposite direction 54, the rod 28 is rotated through 180° to the other position in which it is adapted to be held fixed so that the nozzles 40 would discharge water on the opposite side of the drum 10.

It will be understood that, although the invention has been exemplified particularly with reference to rotary cutting drums whereof the cutting action is essentially normal to the drum periphery, armed with cutting bits in the form of picks, the invention may also be applied to rotary cutting means whereof the cutting action is in an axial direction as is the case with some narrow seam coal or rock cutters, rock borers, raise borers, tunnel borers, drive borers and the like.

Also the invention is not limited to use with rotary cutting means armed with picks. Depending on the type of rock to be cut, the high pressure water jets may coact with any compatible rock cutting means known in the art, including roller bits, disc bits, hard rock cutting teeth, optionally vibration assisted.

What is claimed is:

1. An accessory for a mining or tunnelling machine comprising a cutting drum, the accessory including:

a radial piston pump comprising a plurality of piston and cylinder assemblies, each piston and cylinder assembly being adapted to supply water under pressure to one or more nozzles for directing water on to material to be cut by the machine, the radial piston pump being mountable in the cutting drum;

a hollow shaft adapted for driving the cutting drum;

a hollow rod coaxially and non-rotatably located in the bore of the hollow shaft; and a low pressure swivel mounted on the inlet side of the hollow rod and being connectable to a supply of low pressure water;

the bore of the hollow rod being in communication with the suction side of the rotary piston pump and with the low pressure swivel for conveying low pressure water to the pump.

2. An accessory for a mining or tunnelling machine as claimed in claim 1, wherein one end of the hollow rod is adapted to be held in any one of a plurality of substantially fixed positions, the other end of the rod comprising a cam adapted to cause the pistons of the pump to reciprocate when the drum is rotated.

3. An accessory as claimed in claim 2, in which the cam is in the form of a cylindrical formation eccentrically mounted on the rod.

4. An accessory for a mining or tunnelling machine comprising a cutting drum, the accessory including:

a plurality of radial piston pumps arranged in an axially spaced apart relation;

each pump comprising a plurality of piston and cylinder assemblies, each piston and cylinder assembly being adapted to supply water under pressure to one or more nozzles for directing water onto material to be cut by the machine, the radial piston pumps being mountable in the cutting drum;

a hollow shaft adapted for driving the cutting drum; and a hollow rod coaxially and non-rotatably located in the bore of the hollow shaft, the bore of the rod being in communication with the supply side of each rotary piston pump for conveying low-pressure water thereto.

5. An accessory for a mining or tunnelling machine comprising a cutting drum, the accessory including:

a radial piston pump comprising at least two banks of piston and cylinder assemblies, each piston and cylinder assembly being adapted to supply water under pressure to one or more nozzles for directing water onto material to be cut by the machine, the radial piston pump being mountable in the cutting drum;

a hollow shaft adapted for driving the cutting drum; and a hollow rod coaxially and non-rotatably located in the bore of the hollow shaft, the bore of the rod being in communication with the supply side of the rotary piston pump for conveying low pressure water thereto.

6. An accessory for a mining or tunneling machine comprising a cutting drum, the accessory including:

a radial piston pump comprising a plurality of piston and cylinder assemblies, each piston and cylinder assembly being adapted to supply water under pressure to one or more nozzles for directing water onto material to be cut by the machine, the radial piston pump being mountable in the cutting drum;

a hollow shaft adapted for driving the cutting drum;

a hollow rod coaxially located in the bore of the hollow shaft; and a low-pressure swivel mounted on the inlet side of the hollow rod and being connectable to a supply of low-pressure water, the bore of the rod being in communication with the suction side of the rotary piston pump and with the low pressure swivel for conveying low pressure water to the pump, one end of the rod being adapted to be held in any one of a plurality of substantially fixed positions, the other end of the rod comprising a cam adapted to cause the pistons of the pump to reciprocate when the drum is rotated.

7. An accessory as claimed in claim 6 in which the cam is in the form of a cylindrical formation eccentrically mounted on the rod.

8. An accessory as claimed in claim 6, comprising a plurality of pumps arranged so that one pump is axially spaced from the other.

9. An accessory as claimed in claim 6 in which the pump comprises at least two banks of piston and cylinder assemblies.

10. An accessory for a mining or tunnelling machine comprising a cutting drum, the accessory including:

a radial piston pump including a plurality of piston and cylinder assemblies, at least one nozzle connected to each piston and cylinder assembly, each piston and cylinder assembly being adapted to supply water under pressure to said nozzles for directing water onto material to by cut by the machine, the radial piston pump being mountable on the cutting drum;

a hollow shaft coupled to the cutting drum for driving the same; and a hollow rod coaxially located in the bore of the hollow shaft, the bore of the rod being in communication with the supply side of the radial piston pump for conveying low-pressure water thereto, one end of the rod being adapted to be held in any one of a plurality of substantially fixed positions, the other end thereof comprising a cam adapted to cause the pistons of the pump to reciprocate when the pump is rotated.

11. An accessory as claimed in claim 10 and including a manifold means between said rotary piston pump and said nozzles for supplying high-pressure water from the rotary piston pump to each of said nozzles via said manifold.

12. An accessory as claimed in claim 10 in which the cam is in the form of a cylindrical formation eccentrically mounted on the rod.

* * * * *